US006014109A

United States Patent [19]

Raby

[11] Patent Number: 6,014,109

[45] Date of Patent: Jan. 11, 2000

[54] OFFSET-ANTENNA TOTAL STATION

[75] Inventor: Peter Raby, London, United Kingdom

[73] Assignee: Trimble Navigation Limited, Sunnyvale, Calif.

[21] Appl. No.: 09/021,738

[22] Filed: Feb. 11, 1998

[51] Int. Cl.[7] ..... H01Q 3/00; H01Q 3/02

[52] U.S. Cl. ..... 343/765; 343/757; 343/882; 342/357; 342/352

[58] Field of Search ..... 343/757, 765, 343/703, 882; 342/357, 352; H01Q 3/00, 3/02

[56] References Cited

U.S. PATENT DOCUMENTS 5,077,557 12/1991 Ingensand ..... 342/52
5,233,357 8/1993 Ingensand et al. ..... 342/352
5,471,218 11/1995 Talbot et al. ..... 342/357

*Primary Examiner*—Don Wong
*Assistant Examiner*—Hoang Nguyen
*Attorney, Agent, or Firm*—Wagner, Maurabito & Hao LLP

[57] ABSTRACT

The present invention provides a method and apparatus for expediently determining the azimuthal orientation of a total station. In one embodiment, the present invention is comprised of a total station having a vertical axis. The total station also includes a rotational alidade portion adapted to rotate about the vertical axis, and an electronic distance measuring portion. The present invention also includes a satellite-based position determining system antenna coupled to the total station. In the present invention, the satellite-based position determining system antenna is offset from the vertical axis. That is, in the present invention, the satellite-based position determining system antenna is not disposed coincident with the vertical axis of the total station.

13 Claims, 8 Drawing Sheets

OFFSET-ANTENNA TOTAL STATION

TECHNICAL FIELD

The present invention relates to survey instrumentation. In particular, the present invention pertains to a total station.

BACKGROUND ART

Survey instruments such as total stations are commonly used to map construction sites, record terrain features, measure land parcels, and the like. When using a total station, the surveyor typically must first determine the position and azimuthal orientation of the total station. That is, the surveyor must determine the precise geographic location of the total station, and the surveyor must also determine the direction in which the total station is pointed. This last step is often done by sighting to another reference point whose location is also know, and then calculating the angular orientation of the vector from the total station to the reference point.

A conventional approach for determining the position and azimuthal orientation of a total station is described in conjunction with Prior Art FIG. 1. In order to determine the position (e.g. latitude, longitude, and elevation) of point Z, a surveyor typically measures the distance from the total station, situated at a first known point X, to a known location at point Y. The known location at point Y is comprised, for example, of a United States Geological Service (USGS) site or landmark which has been previously surveyed and those position and elevation is precisely known. Using the two known locations, x and y, the surveyor calculates a vector location between the two points in the local coordinate system. This automatically gives the angle θ relative to north. Once the position and azimuthal orientation of the total station has been determined, the surveyor is then able to determine the location of point Z.

Recent attempts have been made to incorporate the capabilities of the Global Positioning System (GPS) with conventional total stations. U.S. Pat. No. 5,077,557 to Ingensand, entitled "Surveying Instrument with Receiver for Satellite Position-Measuring System and Method of Operation" filed Dec. 31, 1991, discloses a survey instrument having a single GPS receiver coupleable to the precise center of rotation thereof. Similarly, U.S. Pat. No. 5,233,357 to Ingensand et al., entitled "Surveying System Including an Electro-Optical Total Station and a Portable Receiving Apparatus Comprising a Satellite Position-Measuring System" filed Aug. 3, 1993, discloses a total station having a single GPS receiver coupleable to the precise center of rotation thereof. In both of the above-mentioned Prior Art Patents, the geographic location of the center of the total station/survey instrument is determined using GPS techniques. It will be understood by those of ordinary skill in the art, that the accuracy of the determined location of the total station/survey instrument can be improved using various methods such as differential corrections, real-time kinematics, post processing, and the like. However, such prior art survey systems still require the user to first observe a known/previously surveyed location, and then physically manipulate the total station/survey instrument to determine the azimuthal orientation of the total station with respect to north.

Hence, even though some prior art approaches simplify the process of determining the geographic location of the total station/survey instrument, conventional survey techniques and systems still require the surveyor to physically manipulate the total station/survey instrument to determine the azimuthal orientation thereof.

Thus, a need has arisen for a method and apparatus for expediently determining the azimuthal orientation of a total station without first having to observe and/or calculate the location of the total station with respect to a known site.

DISCLOSURE OF THE INVENTION

The present invention provides a method and apparatus for expediently determining the azimuthal orientation of a total station. More specifically, in one embodiment, the present invention is comprised of a total station having a centrally located vertical axis. The total station also includes an electronic distance measuring portion, and a rotational alidade portion adapted to rotate about the centrally located vertical axis. The present invention also includes a satellite-based position determining system antenna coupled to the total station. In the present invention, the satellite-based position determining system antenna is offset from the centrally located vertical axis. That is, in the present invention, the satellite-based position determining system antenna is not disposed coincident with the centrally located vertical axis of the total station. Thus, upon receiving satellite-based position information signals, the present invention is able to determine the azimuthal orientation of the total station without first observing the location of the total station with respect to a known site.

In another embodiment, the present invention is comprised of a total station having a centrally located vertical axis, a rotational alidade portion adapted to rotate about the centrally located vertical axis, and an electronic distance measuring portion. The present invention also includes a two antennas satellite-based position determining system wherein both of the antennae are coupled to the total station. In the present embodiment, both of the satellite-based position determining system antennas offset from the centrally located vertical axis such that the two satellite-based position determining system antennae are not disposed coincident with the centrally located vertical axis of the total station. Additionally, in the present embodiment, both of the satellite-based position determining system antennas are arranged substantially equidistant from the centrally located vertical axis such that a straight line extending from the first satellite-based position determining system antenna to the second satellite-based position determining system antenna has its midpoint coincident with the centrally located vertical axis. As in the previous embodiment, upon receiving satellite-based position information signals, the present invention is able to determine the azimuthal orientation of the total station without first observing the location of the total station with respect to a known site.

In another embodiment, the present invention is comprised of a total station having a centrally located vertical axis. The total station also includes an electronic distance measuring portion, and a rotational alidade portion adapted to rotate about the centrally located vertical axis. The present invention also includes a satellite-based position determining system antenna coupled to the total station. In the present invention, the satellite-based position determining system antenna is offset from the centrally located vertical axis. In the present embodiment, a second antenna is mounted on a pole located some distance away from the total station. The second antenna is sighted through the total station, and data is transferred from the second antenna to the total station in order to accurately calculate position information.

Other advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
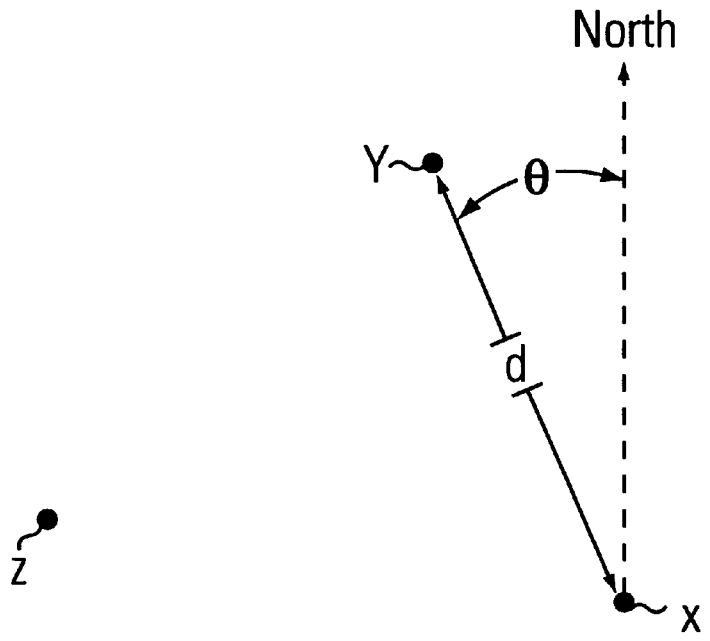
FIG. 1 (Prior Art)
FIG. 1 is a schematic diagram of various points used in a Prior Art survey performed with a conventional total station.
Figure 2:
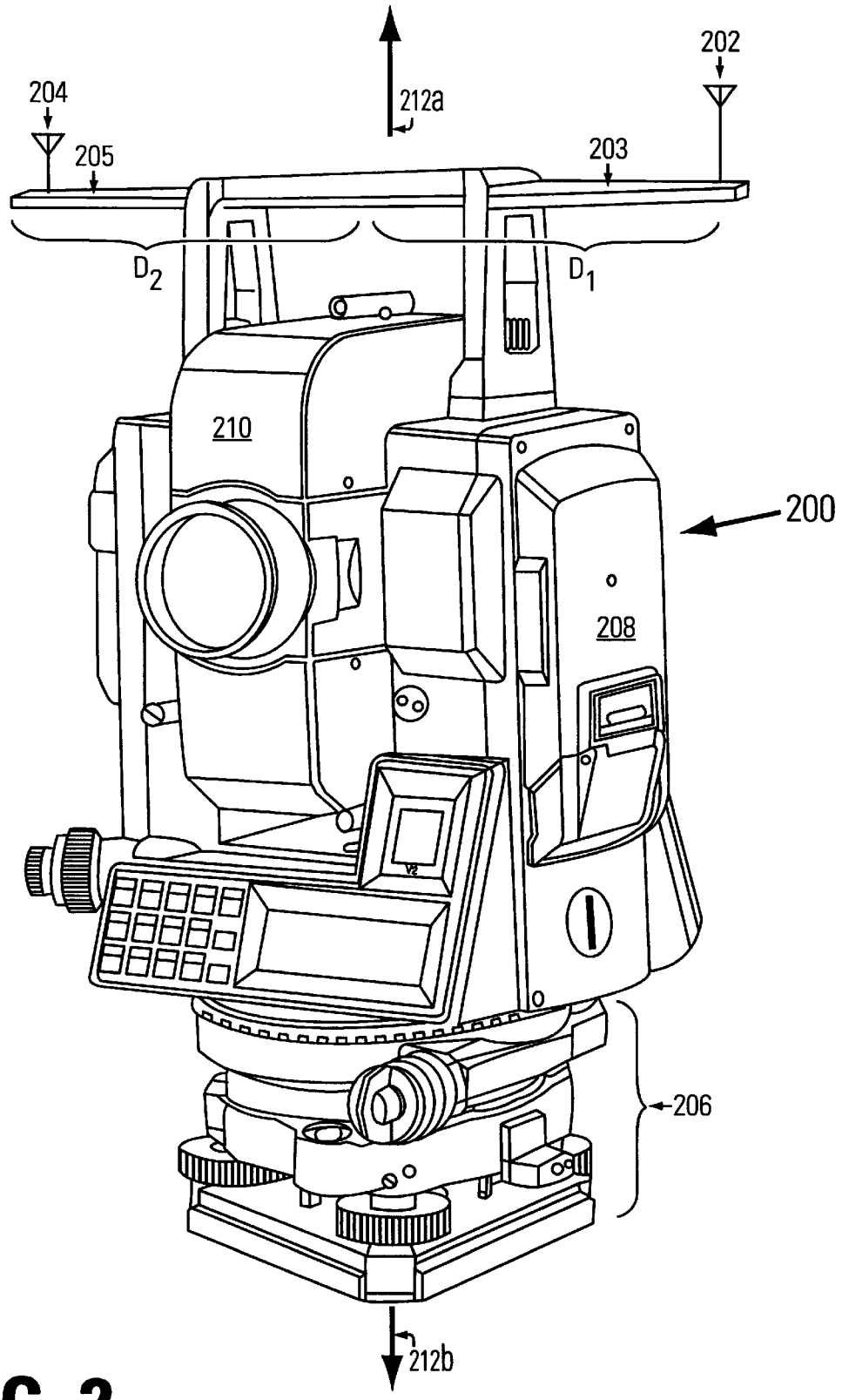
FIG. 2 is a perspective view of a total station having offset GPS antennas coupled thereto in accordance with the present invention.

With reference now to FIG. 2, a perspective view of one embodiment of the present invention is shown. In the embodiment of FIG. 2, a measurement apparatus, e.g. a total station 200, has a two antennas 202 and 204 coupled thereto. In the present embodiment, antennas 202 and 204 are comprised of satellite-based position determining system antennas adapted to receive position information signals transmitted from Global Positioning System (GPS) satellites. In the present invention, antennas 202 and 204 are adapted to receive such position information signals from, for example, a satellite-based radio navigation system such as the GPS, or the Global Orbiting Navigational System (GLONASS). Although such systems are specifically mentioned in the present embodiment, the present invention is also well suited to receiving position information signals from land-based radio navigation systems such as, for example, LORAN, FM subcarrier based systems, and the like. FM subcarrier positioning techniques are described, for example, in U.S. Pat. Nos. 5,173,710 and 5,280,295 to Kelley et al., both entitled "Navigation and Positioning System and Method Using Uncoordinated Beacon Signals" filed Aug. 15, 1991, and Dec. 22, 1992, respectively. U.S. Pat. Nos. 5,173,710 and 5,280,295 are incorporated herein by reference as background material. Additionally, antennas 202 and 204 are also well suited to receiving GPS ephemeris data. Total station 200 of the present embodiment also includes widely used and well known hardware, not shown, for processing the position information received by antennas 202 and 204.

In the embodiment of FIG. 2, antennas 202 and 204 are coupled to total station 200 by mounting brackets 203 and 205, respectively. Each of mounting brackets 203 and 205 has a first end which is coupled to total station 200, and a second end which is coupled to a respective antenna. In the embodiment of FIG. 2, antenna 202 is disposed a distance, $D_1$, from the center of total station 200. Similarly, antenna 204 is disposed a distance, $D_2$, from the center of total station 200, where $D_2$ is equal to distance $D_1$. In the present embodiment antennas 202 and 204 are separated by a distance of at least approximately 22 centimeters. Additionally, in this embodiment, antenna 202 and antenna 204 are arranged such that a straight line extending from antenna 202 to antenna 204 has its midpoint coincident with the centrally located vertical axis of total station 200. Although such a separation distance and antenna placement configuration is recited in the present embodiment, the present invention is also well suited to having various other separation distances and antenna placement configurations. Several of these various separation distances and antenna placements configurations are described below and illustrated in the accompanying figures.

With reference still to FIG. 2, total station 200 is comprised of a base portion 206, a rotational alidade portion 208, and an electronic distance measuring portion 210. Rotational alidade portion 208 is adapted to rotate on base portion 206 about a centrally located vertical axis represented by arrows 212*a* and 212*b*. That is, rotational alidade portion 208 is able to rotate 360 degrees on base 206. Additionally, electronic distance measuring portion 210 is adapted to swivel upwards or downwards within rotational alidade portion 208. In so doing, it is possible to aim electronic distance measuring portion 210 towards a wide variety of elevations and in any of the 360 degrees through which rotational alidade portion 208 can be rotated.

In the present invention, antenna 202 and antenna 204 are disposed such that neither of antennas 202 or 204 is coincident with the centrally located vertical axis of total station 200. That is, in the present invention, the antennae are offset from the centrally located vertical axis represented by arrows 212*a* and 212*b*.

Figure 3:
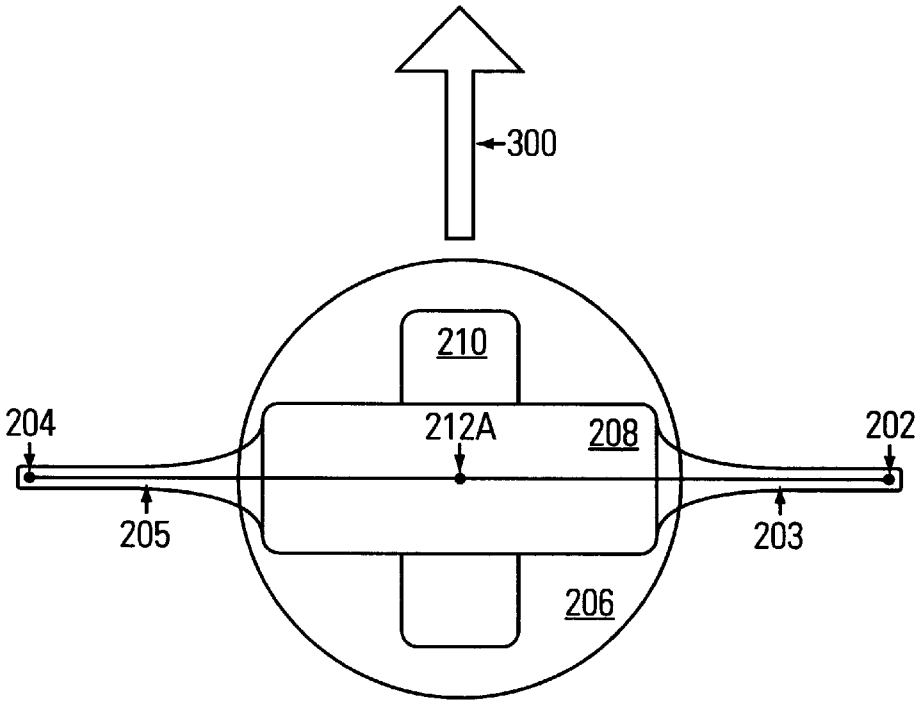
FIG. 3 is a top plan view of the total station of FIG. 2 in accordance with the present invention.

With reference now to FIG. 3, a top plan view of total station 200 of FIG. 2 is shown. More specifically, in the embodiment of FIGS. 2 and 3, neither antenna 202 nor antenna 204 is coincident with the centrally located vertical axis, of total station 200, represented by arrow 212*a* (coming out of the page). It will be understood that the offset of antennas 202 and 204 from the center of total station 200 must be calculated either in the factory or in the field.

In the present invention, in order to determine the azimuthal orientation of total station 200, the following steps are performed. First, position information is received at antenna 202 and at antenna 204. Next, the present invention calculates the azimuthal orientation of total station 200 using the position information received at antenna 202 and antenna 204. More specifically, the present invention determines the azimuthal orientation of total station 200 using relative phase differences in antennas 202 and 204 using techniques described in the prior art and related literature (see e.g., U.S. Pat. No. 5,347,286 to Babitch, entitled "Automatic Antenna Pointing System Based on Global Positioning System (GPS) Attitude Information").

That is, the present invention uses the position information to determine the direction perpendicular to the line extending between antenna 202 and antenna 204. Such a direction is indicated by arrow 300 of FIG. 3. Thus, if antennas 202 and 204 are oriented such that a line extending therebetween is perpendicular to the line of sight of electronic distance measuring portion 210, the direction of line 213 determined by the present invention will be parallel to the line of sight of electronic distance measuring portion 210. Hence, by knowing the orientation of antennas 202 and 204 with respect to total station 200, the present invention is able to determine the azimuthal orientation of total station 200 without having to first observe a known location. Although antennas 202 and 204 are oriented such that a line extending therebetween is perpendicular to the line of sight of electronic distance measuring portion 210 in the present embodiment, the present invention is also well suited to use then the antennas 202 and 204 are oriented such that a line extending therebetween is not perpendicular to the line of sight of electronic distance measuring portion 210. In such instances, an offset must be calculated to compensate for the difference in the direction calculated by the present invention and the direction in which the electronic distance measuring portion is aimed.

Additionally, the present invention is able to accurately determine the center of total station 200. Moreover, even though no antenna is located at the center of total station 200 (coincident with the centrally located vertical axis represented by arrows 212*a* and 212*b*), the present invention can readily determine the position of the center of total station 200. Such a position determination is accomplished by knowing the location of antennas 202 and 204 with respect to the center of total station 200, and by employing well known position information processing methods. Numerous commonly-owned United States Patents describing such position information processing methods are set forth below.

A detailed description of relative phase calculations, and the methods and apparatus utilized by the present invention to perform such calculations is set forth in commonly-owned U.S. Pat. No. 5,268,695 to Dentinger et al. entitled "Differential Phase Measurement Through Antenna Multiplexing." The Dentinger et al. reference was filed Oct. 6, 1992, and is herein incorporated by reference. Additional differential phase and attitude orientation determination techniques are described, for example, in commonly-owned U.S. Pat. Nos. 5,561,432 and 5,296,861 to Knight entitled "Out of Plane Antenna Vector System and Method", and "Method and Apparatus for Maximum Likelihood Estimation Direct Integer Search in Differential Carrier Phase Attitude Determination Systems" filed May 12, 1995, and Nov. 13, 1992, respectively. Further differential phase and attitude orientation determination techniques and systems are recited in commonly-owned U.S. Pat. No. 5,471,218 to Talbot et al. entitled "Integrated Terrestrial Survey and Satellite Positioning System" filed Jul. 1, 1993, and commonly-owned U.S. Pat. No. 5,347,286 to Babitch entitled "Automatic Antenna Pointing System Based on Global Positioning System (GPS) Attitude Information" filed Mar. 19, 1993. U.S. Pat. Nos. 5,561,432, 5,296,861, 5,471,218, and 5,347,286 are incorporated herein by reference as background material.

Thus, the present invention provides for the determination of the azimuthal orientation of a total station without requiring the observation of a known location.

Figure 4:
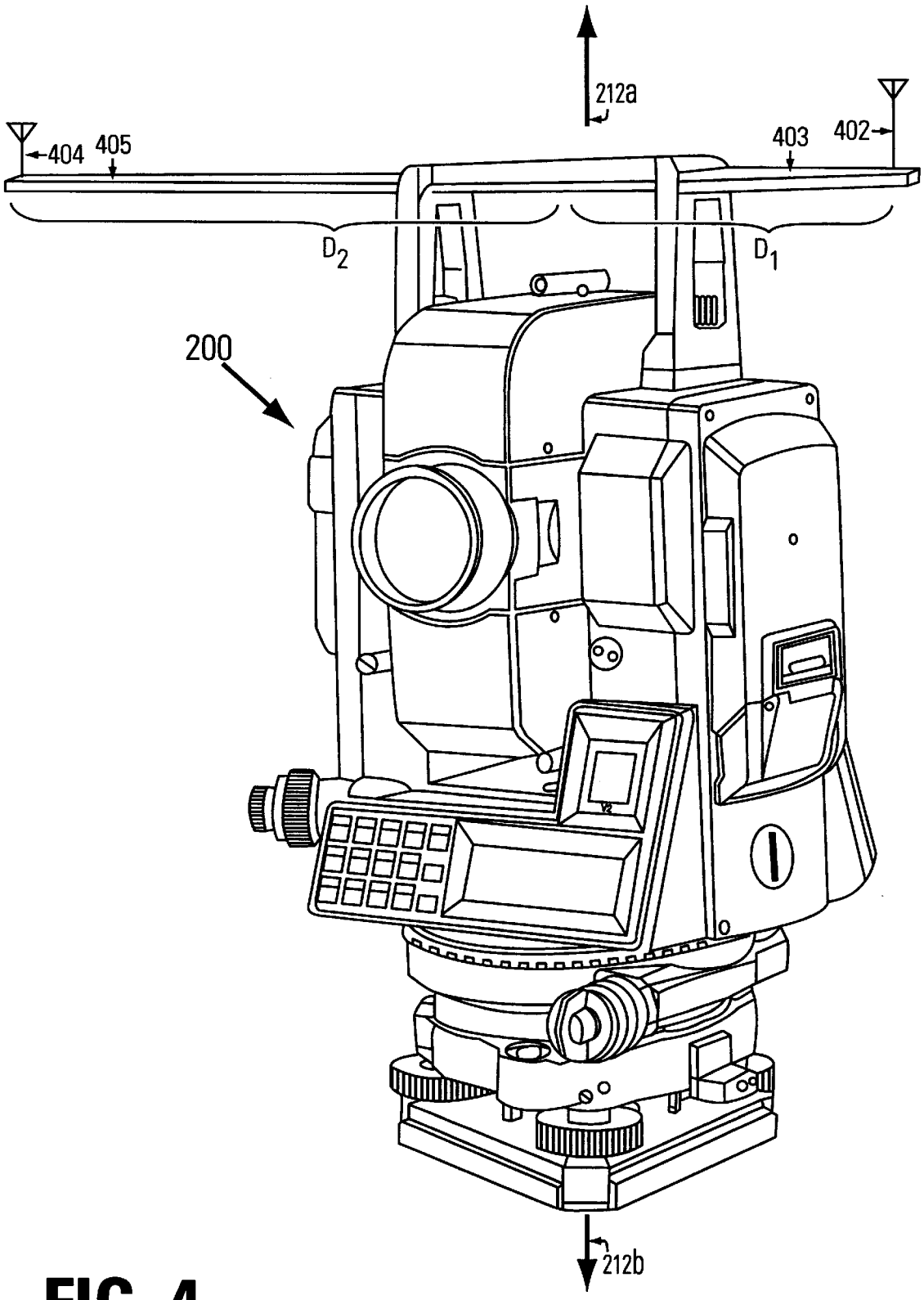
FIG. 4 is a perspective view of another embodiment of a total station having offset GPS antennae coupled thereto in accordance with the present invention.

With reference next to FIG. 4, another embodiment of an antenna-equipped total station 200 is shown. In the embodiment of FIG. 4, total station 200 has a two antennas 402 and 404 coupled thereto. In the present embodiment, antennas 202 and 204 are comprised of satellite-based position determining system antennas adapted to receive position information signals transmitted from GPS satellites.

In the embodiment of FIG. 4, antennas 402 and 404 are coupled to total station 200 by mounting brackets 403 and 405, respectively. Each of mounting brackets 403 and 405 has a first end which is coupled to total station 200, and a second end which is coupled to a respective antenna. In the embodiment of FIG. 4, antenna 402 is disposed a distance, $D_1$, from the center of total station 200. Similarly, antenna 404 is disposed a distance, $D_2$, from the center of total station 200, where $D_2$ is not equal to distance $D_1$. In the present embodiment antennas 402 and 404 are separated by a distance of at least approximately 22 centimeters. Additionally, in this embodiment, antenna 402 and antenna 404 are arranged such that a straight line extending from antenna 402 to antenna 404 does not have its midpoint coincident with the centrally located vertical axis of total station 200.

In the present embodiment, antennas 402 and 404 are disposed such that neither antenna 402 nor antenna 404 is coincident with the centrally located vertical axis of total station 200. That is, in the present invention, the antennae are offset from the centrally located vertical axis represented by arrows 212*a* and 212*b*.

As in the embodiment of FIG. 2, in order to determine the azimuthal orientation of total station 200, the following steps are performed. First, position information is received at antenna 402 and at antenna 404. Next, the present invention calculates the azimuthal orientation of total station 200 using the position information received at antenna 402 and antenna 404. More specifically, the present invention determines the azimuthal orientation of total station 200 using relative phase differences in antennas 402 and 404.

Additionally, the present invention is able to accurately determine the center of total station 200. Moreover, even though no antenna is located at the center of total station 200 (coincident with the centrally located vertical axis represented by arrows 212*a* and 212*b*), the present invention can readily determine the position of the center of total station 200. Such a position determination is accomplished by knowing the location of antennas 402 and 404 with respect to the center of total station 200, and by employing well known position information processing methods.

Figure 5A:
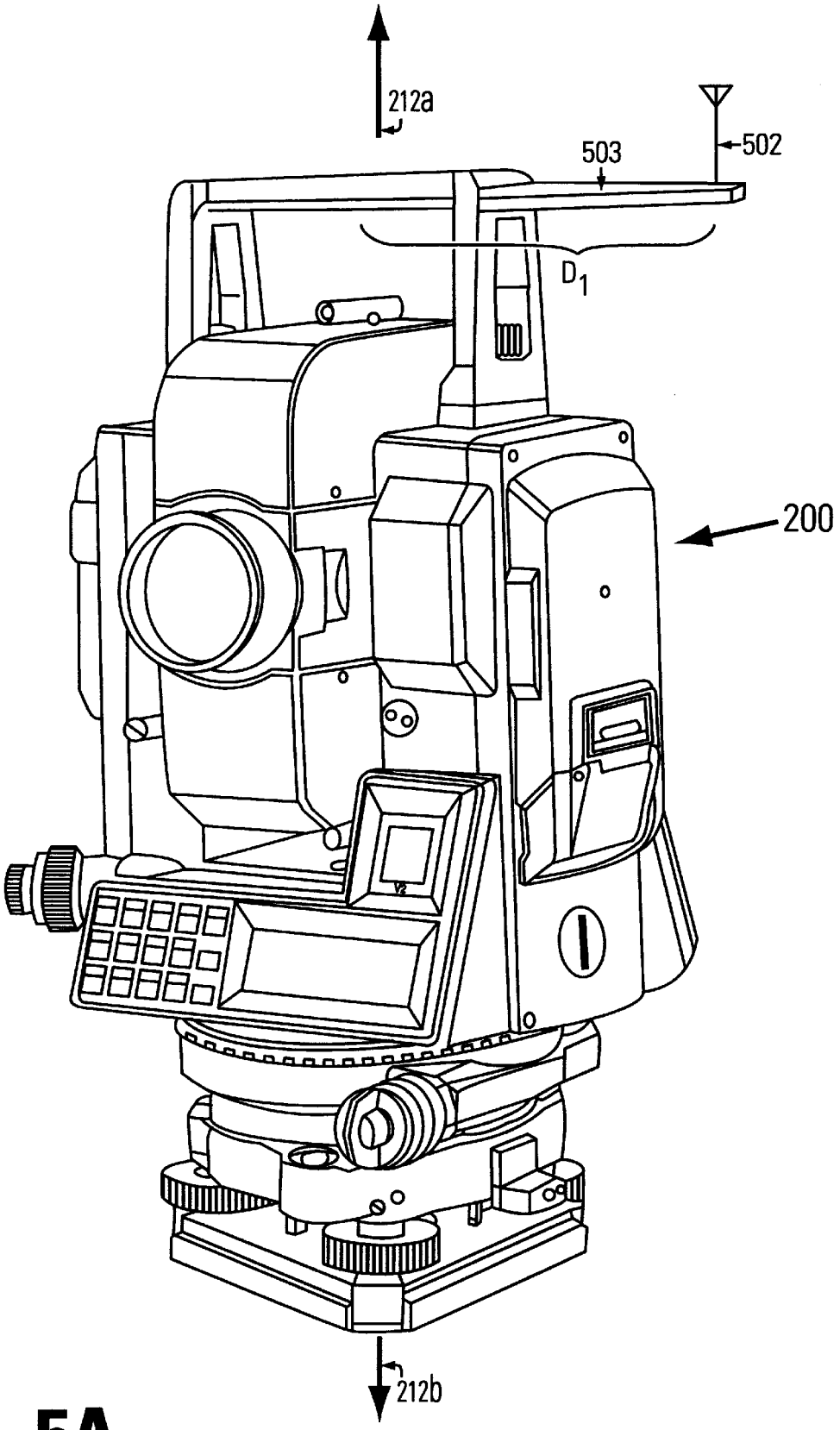
FIG. 5A is a perspective view of another embodiment of a total station having a single offset GPS antenna coupled thereto in accordance with the present invention.

With reference next to FIG. 5A, another embodiment of a total station 200 equipped with a single antenna is shown. In the embodiment of FIG. 5A, total station 200 has a single antenna 502 coupled thereto. In the present embodiment, antenna 502 is comprised of a satellite-based position determining system antenna adapted to receive position information signals transmitted from GPS satellites.

Figure 5B:
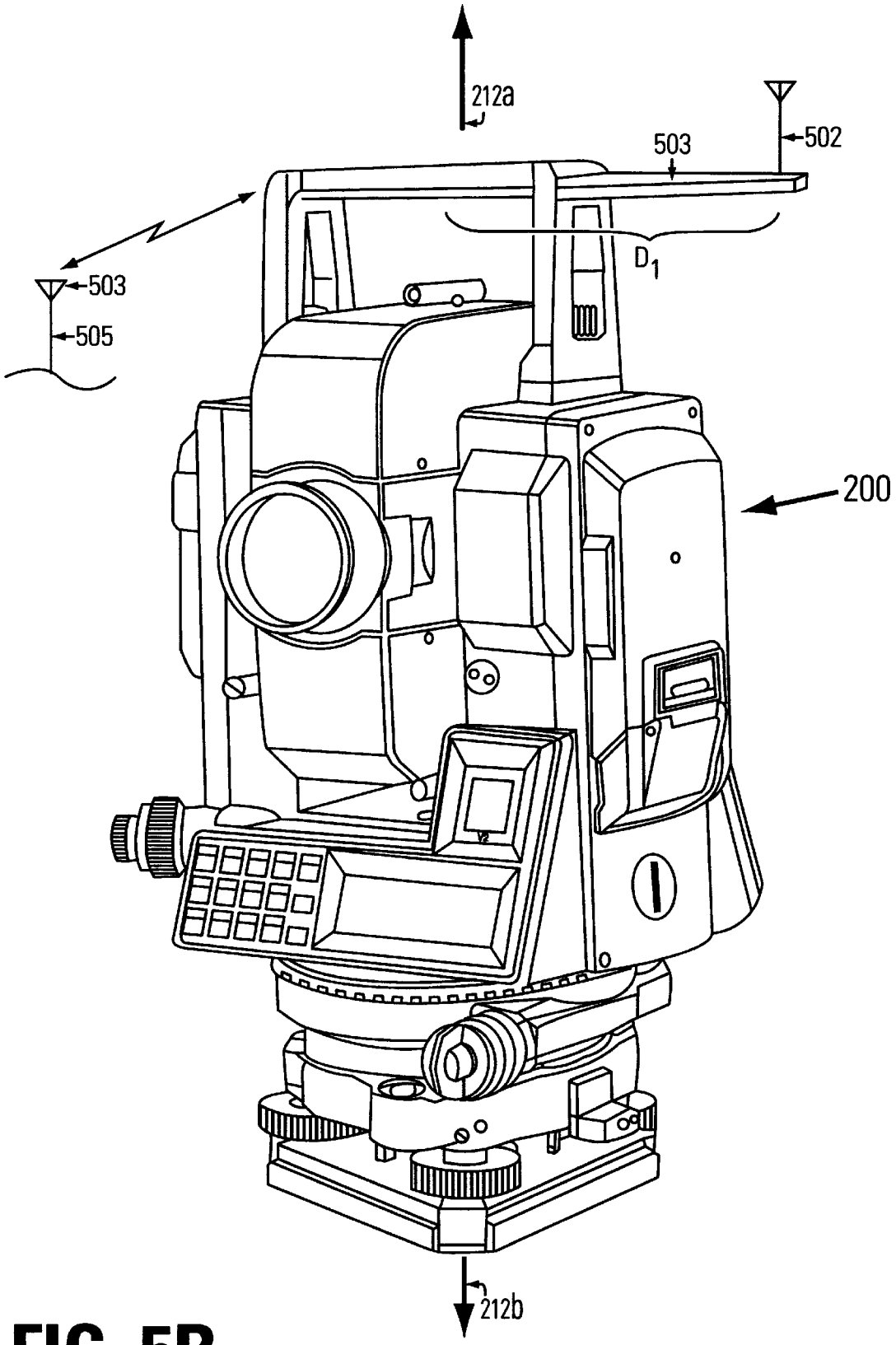
FIG. 5B is a perspective view of another embodiment of a total station having a single offset GPS antenna coupled thereto and a second antenna located distant from the total station but communicatively coupled to the total station in accordance with the present invention.

Referring now to FIG. 5B, another embodiment of a total station 200 equipped with a single antenna is shown. In the embodiment of FIG. 5B, total station 200 has a single antenna 502 physically coupled thereto and a second distantly located antenna 503 communicatively coupled to total station 200. In the present embodiment, antennas 502 and 503 are comprised of a satellite-based position determining system antenna adapted to receive position information signals transmitted from GPS satellites. As in the embodiment of FIG. 5A, total station 200 has a centrally located vertical axis. Total station 200 also includes an electronic distance measuring portion, and a rotational alidade portion adapted to rotate about the centrally located vertical axis. In the embodiment of FIG. 5B, a second antenna 503 is mounted on a pole 505 located some distance away from total station 200. Second antenna 503 is sighted through total station 200, and data is transferred from second antenna 503 to total station 200 in order to accurately calculate position information.

In the embodiments of FIGS. 2 and 4, antenna 502 is coupled to total station 200 by a single mounting bracket 503. Mounting bracket 503 has a first end which is coupled to total station 200, and a second end which is coupled to antenna 502. In the embodiment of FIGS. 6A and 5B, antenna 502 is disposed a distance, $D_1$, from the center of total station 200.

In the embodiment of FIG. 5B, antenna 502 is disposed such that it is not coincident with the centrally located vertical axis of total station 200. That is, in the present invention, the antenna are offset from the centrally located vertical axis represented by arrows 212*a* and 212*b*.

In the embodiment of FIG. 5A, in order to determine the azimuthal orientation of total station 200, the following steps are performed. First, position information is received at antenna 502 when antenna 502 is disposed at a first location. Next, the alidade of the total station is rotated such that antenna 502 is disposed in a second location. Then, position information is received at antenna 502 when antenna 502 is disposed at the second location. The difference in angular position between the first location and the second location can be measured using the angle measuring system of total station 200. Alternatively, total station 200 can take measurements from the antenna while pointing to some target on face 1 and face 2. In such a case, the angle would be known from existing calibrations of total station 200. The present invention then calculates the azimuthal orientation of total station 200 using the position information received by antenna 502 at each of the two locations. More specifically, the present invention determines the azimuthal orientation of total station 200 using relative phase differences observed between the two locations of antenna 502. In the present embodiment, the determined azimuthal orientation corresponds to the total station when oriented such that antenna 502 is disposed in the second location.

Additionally, the present invention is able to accurately determine the center of total station 200. Moreover, even though antenna 502 is not located at the center of total station 200 (coincident with the centrally located vertical axis represented by arrows 212*a* and 212*b*), the present invention can readily determine the position of the center of total station 200. Such a position determination is accomplished by knowing the location of antenna 502 with respect to the center of total station 200, and by employing well known position information processing methods.

Figure 6:
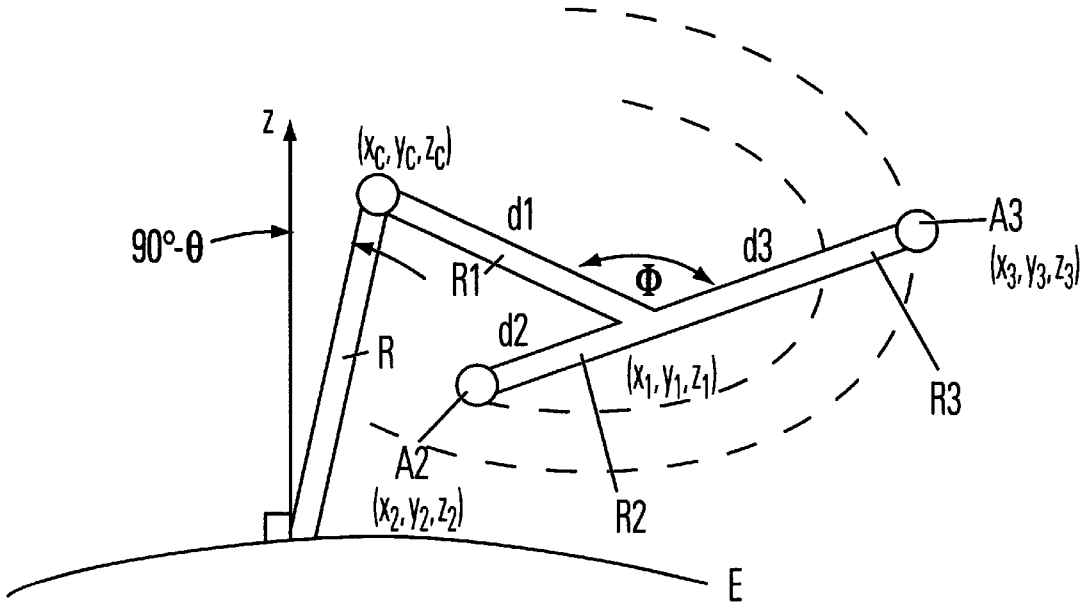
FIG. 6 is a perspective view illustrating an analytical representation of one configuration of the embodiment of FIG. 4 in accordance with the present claimed invention.

FIG. 6 illustrates, in a perspective view, the offset antenna arrangement according to the embodiment shown in FIG. 4, with an additional offset from the center location for further generality. An approximately vertical rod R, oriented at an angle θ (≈90°) relative to a plane P that is locally tangent to the surface of a defining ellipsoid E, is attached by a first offset rod R1 of length d1 to a second offset rod R2 of length d2 and to a third offset rod R3 of length d3, as shown. The first, second and third rods join together at one end of each offset rod, at a location J1 having coordinates $(x_1,y_1,z_1)$, and the first offset rod R1 is joined to the vertical rod R, at approximately a right angle, at a center location with unknown location coordinates $(x_c,y_c,z_c)$. The other ends of the first, second and third offset rods have the respective location coordinates $(x_1, y_1,z_1)$ $(x_2,y_2,z_2)$ and $(x_3,y_3,z_3)$ as shown, and each of these other ends of the second offset rod R2 and the third offset rod R3 has a GPS antenna A2 and A3, respectively, located thereat. As the vertical rod R rotates about its longitudinal axis, the offset antennas A2 and A3 rotate in a plane that is approximately perpendicular to the longitudinal axis of the rod R. For purposes of this discussion, it is assumed that θ=90° and that the offset antennas A2 and A3 rotate in an offset xy-plane corresponding to $z=\sec=z_1=Z_2=z_3$=known constant.

The following development provides a procedure for calculating the center coordinates $(x_c,y_c,z_c)$ for the vertical rod R. The first offset rod R1 (of length d1) is oriented at an angle ϕ relative to the third offset rod and is oriented at an angle 180°−ϕ relative to the second offset rod, as shown in FIG. 6. FIG. 6 illustrates a translation or offset of the x-axis and y-axis to a translated axis pair (x',y'), where the first offset rod longitudinal axis is oriented at an angle ϕ relative to the (fixed) y'-axis. The location coordinates $(x_2,y_2)$ and $(x_3,y_3)$ (and also $z_2=z_3$) are assumed to be known through GPS location determination. The location coordinates $(x_1, y_1)$ of the join point J1 are determined using the following relations, or an equivalent formulation.

$$xc=(d3\cdot x_2+d2\cdot x_3)/(d2+d3), \quad (1)$$

$$yc=(d3\cdot y_2+d2\cdot y_3)/(d2+d3), \quad (2)$$

$$x1=x_c+d1\cdot\sin\phi, \quad (3)$$

$$y1=x_c+d1\text{-}\cos\phi, \quad (4)$$

This configuration can be extended to a more general configuration in which the angle θ is not 90° and/or the offset antennas A2 and A3 do not rotate in a plane perpendicular to longitudinal axis of the rod R.

Figure 7:
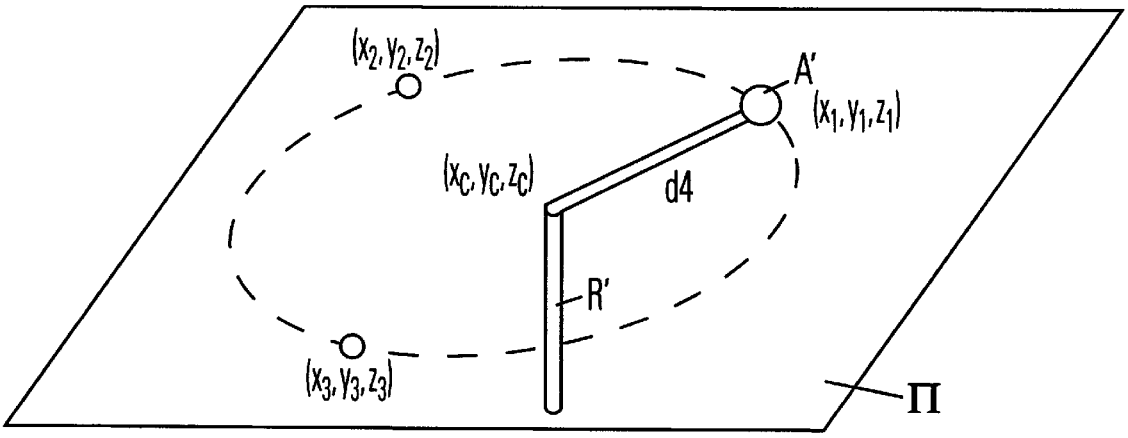
FIG. 7 is a perspective view illustrating an analytical representation of one configuration of the embodiment of FIG. 5A in accordance with the present claimed invention.

FIG. 7 is a perspective view illustrating an embodiment of the invention shown in FIG. 5A. A single antenna A' is rotatably attached by a rod R' of length d4 to the GPS center (e.g., an approximately vertical range pole), which has unknown location coordinates $(x_c,y_c,z_c)$. These unknown coordinates for the GPS center may be determined by the following. The antenna A' rotates in a plane Π that is described by the equations $$a(x-x_c)+b(y-y_c)+c(z-z_c)=0, \quad (5)$$

$$a^2+b^2+c^2=1. \quad (6)$$

The coefficients a, b and c may be interpreted as direction cosines for the rod R' (a vector normal to the plane II), for example in the form $$a=\cos\phi\cos\theta, \quad (7)$$

$$b=\sin\phi\cos\theta, \quad (8)$$

$$c=\cos\theta, \quad (9)$$

where ϕ and θ are the respective azimuthal and polar angles for the rod R', shown in FIG. 7.

In principle, assuming that the coefficients a, b and c are known or are determined by other means, if the location coordinates of the rotatable antenna A' are measured at two distinct locations of the rotated rod R', the center coordinates $(x_c,y_c,z_c)$ can be determined using Eq. (5) and the relations $$(x_1 31\ x_c)^2+(y_1-y_c)^2+(z_1-z_c)^2=(d4)^2, \quad (10)$$

$$(x_2-x_c)^2+(y_2-y_c)^2+(z_2-z_c)^2=(d4)^2, \quad (11)$$

where $(x_1,y_1,z_)$and $(x_2,y_2,z_2)$ are the location coordinates of the two distinct antenna locations. In practice, it may be computationally easier to determine the center coordinates by including the measured antenna coordinates at a third location $(x_3,y_3,z_3)$ as well, with $$(x_3-x_c)^2+(y_3-y_c)^2+(z_3-z_c)^2=(d4)^2, \quad (12)$$

Forming a first difference of Eq. (11) and Eq. (10) and a second difference of Eq. (12) and Eq. (10), plus Eq. (5), produces three linear equations $$a(x_1-x_c)+b(y_1-y_c)+c(z_1z_c)=0, \quad (5')$$

$$2(x_1-x_2)x_c+2(y_1-y_2)y_c+2(z_1-z_2)z_c=r1^2-r2^2, \quad (13)$$

$$2(x_1-x_3)x_{c+}2(y_1-y_3)y_c+2(z_1-z_3)z_c=r1^2-r3^2, \quad (14)$$

with $$r_i^2=x_i^2+y_i^2+z_i^2,\ (i=1,2,3). \quad (15)$$

Solutions $(x_c,y_c,z_c)$ of the three linear equations (5'), (13) and (14) are easily determined using standard algebraic techniques for inversion of linear equations.

Thus, the present invention provides a method and apparatus for expediently determining the azimuthal orientation of a total station.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

It is claimed:

1. A measurement apparatus comprising:

a total station having a centrally located vertical axis of rotation, said total station further comprising:

a rotational alidade portion adapted to rotate about said vertical axis, and an electronic distance measuring portion; and a satellite-based position determining system antenna coupled to said total station, said satellite-based position determining system antenna is offset from said vertical axis such that said satellite-based position determining system antenna is not disposed coincident with said vertical axis of said total station.

2. The measurement apparatus of claim 1 further comprising:

a mounting bracket having a first end and a second end, said first end of said mounting bracket coupled to said total station, said second end of said mounting bracket coupled to said satellite-based position determining system antenna.

3. A measurement apparatus comprising:

a total station having a vertical axis of rotation, said total station further comprising:

a rotational alidade portion adapted to rotate about said vertical axis of rotation, and an electronic distance measuring portion;

a first satellite-based position determining system antenna coupled to said total station, said first satellite-based position determining system antenna is offset from said vertical axis of rotation such that said first satellite-based position determining system antenna is not disposed coincident with said vertical axis of rotation of said total station; and a second satellite-based position determining system antenna coupled to said total station, said second satellite-based position determining system antenna is offset from said vertical axis of rotation such that said second satellite-based position determining system antenna is not disposed coincident with said vertical axis of rotation of said total station, said first and said second satellite-based position determining system antennas are arranged substantially equidistant from said vertical axis of rotation such that a straight line extending from said first satellite-based position determining system antenna to said second satellite-based position determining system antenna has its midpoint coincident with said vertical axis of rotation.

4. The measurement apparatus of claim 3 further comprising:

a mounting bracket coupled to said total station, said mounting bracket having a first end and a second end, said first end of said mounting bracket coupled to said first satellite-based position determining system antenna, said second end of said mounting bracket coupled to said second satellite-based position determining system antenna.

5. A multi-antenna measurement apparatus comprising:

a total station having a vertical axis or rotation, said total station further comprising:

a rotational alidade portion adapted to rotate about said vertical axis, and an electronic distance measuring portion; and a plurality of satellite-based position determining system antennas coupled to said total station, each of said plurality of satellite-based position determining system antennas is offset from said vertical axis such that none of said satellite-based position determining system antennas is disposed coincident with said vertical axis of said total station.

6. The multi-antenna measurement apparatus of claim 5 wherein said plurality of satellite based position determining antennae are comprised of:

a first satellite-based position determining system antenna coupled to said total station, said first satellite-based position determining system antenna is offset from said vertical axis such that said first satellite-based position determining system antenna is not disposed coincident with said vertical axis of said total station; and a second satellite-based position determining system antenna coupled to said total station, said second satellite-based position determining system antenna is offset from said vertical axis such that said second satellite-based position determining system antenna is not disposed coincident with said vertical axis of said total station, said first and said second satellite-based position determining system antennas are arranged substantially equidistant from said vertical axis and such that a straight line extending from said first satellite-based position determining system antenna to said second satellite-based position determining system antenna does not have its midpoint coincident with said vertical axis.

7. The multi-antenna measurement apparatus of claim 5 wherein said plurality of satellite based position determining antennae are comprised of:

a first satellite-based position determining system antenna coupled to said total station, said first satellite-based position determining system antenna is offset from said vertical axis such that said first satellite-based position determining system antenna is not disposed coincident with said vertical axis of said total station; and a second satellite-based position determining system antenna coupled to said total station, said second satellite-based position determining system antenna is offset from said vertical axis such that said second satellite-based position determining system antenna is not disposed coincident with said vertical axis of said total station, said first and said second satellite-based position determining system antennas are arranged substantially equidistant from said vertical axis and such that a straight line extending from said first satellite-based position determining system antenna to said second satellite-based position determining system antenna has its midpoint coincident with said vertical axis.

8. The multi-antenna measurement apparatus of claim 5 further comprising:

a mounting bracket coupled to said total station, said mounting bracket having a first end and a second end, said first end of said mounting bracket coupled to said first satellite-based position determining system antenna, said second end of said mounting bracket coupled to said second satellite-based position determining system antenna.

9. A method for determining the azimuthal orientation of a total station comprising the steps of:

a) receiving position information at a first antenna coupled to said total station, said first antenna coupled to said total station such that said first antenna is offset from a vertical axis of said total station such that said first antenna is not disposed coincident with said vertical axis of said total station;

b) receiving position information at a second antenna coupled to said total station, said second antenna coupled to said total station such that said second antenna is offset from said vertical axis of said total station such that said first antenna is not disposed coincident with said vertical axis of said total station, said first and said second antennae arranged substantially equidistant from said vertical axis; and c) calculating said azimuthal orientation of said total station using said position information received at said first and said second antennae.

10. The method as recited in claim 9 further comprising receiving said position information at said first and said second antennae wherein said first and said second antennas are arranged such that a straight line extending from said first satellite-based position determining system antenna to said second satellite-based position determining system antenna has its midpoint coincident with said vertical axis.

11. A method for determining the azimuthal orientation of a total station comprising the steps of:

a) receiving position information at an antenna coupled to said total station, said total station positioned to place said antenna in a first location, said antenna coupled to said total station with said antenna offset from a vertical axis of said total station such that said antenna is not disposed coincident with said vertical axis of said total station;

b) positioning said total station such that said antenna is disposed in a second location;

b) receiving position information at said antenna coupled to said total station and disposed at said second location; and c) calculating said azimuthal orientation of said total station using said position information received at said antenna at said first and second locations.

12. The method as recited in claim 11 further comprising receiving said position information at said antenna when disposed at said first and second locations such that a straight line extending from said first and second locations of said antenna has its midpoint approximately coincident with said vertical axis.

13. A measurement apparatus comprising:

a total station having a vertical axis of rotation, said total station further comprising:

a rotational alidade portion adapted to rotate about said vertical axis of rotation, and an electronic distance measuring portion;

a first satellite-based position determining system antenna coupled to said total station, said first satellite-based position determining system antenna is offset from said vertical axis of rotation such that said first satellite-based position determining system antenna is not disposed coincident with said vertical axis of rotation of said total station; and a second satellite-based position determining system antenna located distant from said total station, said second satellite-based position determining system antenna communicatively coupled to said total station.

* * * * *